US012559884B2

(12) United States Patent
Groh et al.

(10) Patent No.: US 12,559,884 B2
(45) Date of Patent: Feb. 24, 2026

(54) BINDER-CONSOLIDATED TEXTILE FABRIC, METHOD FOR ITS MANUFACTURE AND ITS USE

(71) Applicant: JOHNS MANVILLE, Denver, CO (US)

(72) Inventors: Werner Groh, Schwabmunchen (DE); Agnes Frick, Gunzberg (DE); Kiarash Alavi, Littleton, CO (US); Uranchimeg Lester, Littleton, CO (US); Ameya Natu, Highlands Ranch, CO (US)

(73) Assignee: Johns Manville, Denver, CO (US)

( * ) Notice: Subject to any disclaimer, the term of this patent is extended or adjusted under 35 U.S.C. 154(b) by 760 days.

(21) Appl. No.: 16/537,925

(22) Filed: Aug. 12, 2019

(65) Prior Publication Data

US 2020/0056327 A1 Feb. 20, 2020

(30) Foreign Application Priority Data

Aug. 17, 2018 (EP) ..... 18189496

(51) Int. Cl.

| | |
|---|---|
| ***D06M 15/33*** | (2006.01) |
| ***D06M 13/10*** | (2006.01) |
| ***D06M 13/52*** | (2006.01) |
| ***D06M 15/333*** | (2006.01) |

(52) U.S. Cl.

CPC ..... *D06M 15/333* (2013.01); *D06M 13/10* (2013.01); *D06M 13/52* (2013.01)

(58) Field of Classification Search

None

See application file for complete search history.

(56) References Cited

U.S. PATENT DOCUMENTS

| | | | | |
|---|---|---|---|---|
| 2009/0169867 | A1* | 7/2009 | Kelly | D06M 15/15 428/326 |
| 2011/0020917 | A1* | 1/2011 | Wen | B05D 3/067 525/50 |
| 2012/0064323 | A1* | 3/2012 | Shoemake | C08J 5/043 428/220 |
| 2013/0157030 | A1* | 6/2013 | Frick | D06M 17/00 428/221 |
| 2016/0312941 | A1* | 10/2016 | Alavi | D06M 15/11 |
| 2017/0096521 | A1* | 4/2017 | Niederst | C09D 171/00 |
| 2020/0086616 | A1* | 3/2020 | Meise | B32B 27/30 |

OTHER PUBLICATIONS

University of Alabama in Huntsville (UAH), "Determining Limiting and Excess Reagents." https://www.uah.edu/images/administrative/student-success--center/resources/handouts/handouts_2019/deter (Year: 2019).*

* cited by examiner

*Primary Examiner* — Frank J Vineis
*Assistant Examiner* — Nicole T Gugliotta
(74) *Attorney, Agent, or Firm* — Robert D. Touslee

(57) ABSTRACT

The invention concerns a novel binder system and its use for consolidating textile fabrics, as well as to products containing such consolidated textile fabrics. The materials according to the invention are suitable for the manufacture of reinforcing inserts, optionally in combination with at least one further textile fabric, for coated sarking membranes, roofing and waterproofing sheets, as textile backings or textile reinforcement in flooring, in particular in fitted carpets and PVC flooring, or in facers in wall coatings both in the interior and exterior of buildings, as well as in furniture.

20 Claims, 1 Drawing Sheet

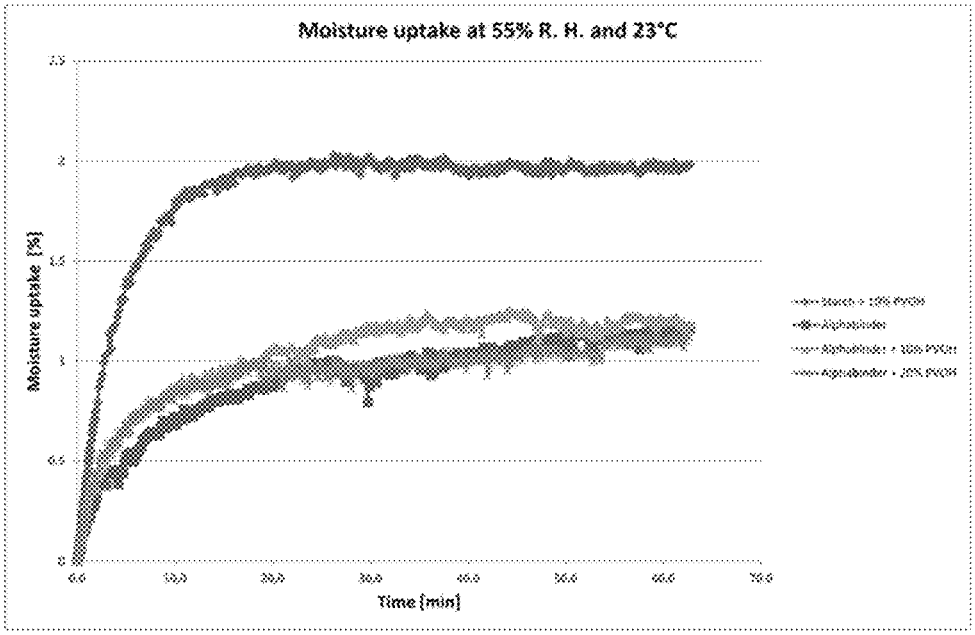
Moisture uptake at 55% R. H. and 23°C
Moisture uptake [%]
Time [min]

BINDER-CONSOLIDATED TEXTILE FABRIC, METHOD FOR ITS MANUFACTURE AND ITS USE

TECHNICAL FIELD

The invention relates to novel binder systems for consolidating textile fabric, textile fabrics consolidated thereby, their manufacture, as well as products containing the binder system or a textile surface equipped therewith.

BACKGROUND

Textile fabrics, in particular those which are used as an insert for the manufacture of coated materials, must meet a wide range of requirements. Examples of the use of such inserts are, among other things, textile backings for fitted carpets, textile reinforcements in PVC flooring or roofing sheets.

When used in the manufacture of roofing sheets, the inserts or reinforcing inserts used must have sufficient mechanical stability, such as good perforation strength and good tensile strength, which are brought about, for example, upon further processing, such as bituminization or laying. In addition, a high resistance to thermal stress, for example in the case of bituminizing or against radiant heat, and resistance to flying sparks is required.

When used in the manufacture of coated flooring, for example PVC flooring, additional demands are placed on such inserts. In this field of application, in addition to the mechanical/thermal requirements, the inserts must also avoid the formation of gaseous substances, since otherwise, blistering would be observed during manufacture, for example by the formation of water vapor. Blistering of this kind is highly problematic and leads to losses in yield or to poorer quality.

Additional requirements are placed on such inserts for use in the manufacture of surfaces in the interior and exterior of buildings. In this field of application, in addition to the mechanical/thermal requirements, the inserts must also have decorative properties which remain unchanged or almost unchanged over a long period of time.

In addition to the aforementioned technical requirements, environmental compatibility or new legal regulations are also responsible for the replacement of existing, occasionally properly functioning systems with new, compliant systems. Examples in this regard include new industrial standards, such as DIN EN 14041, or legislative changes, such as REACH.

The binding systems used hitherto for consolidating textile surfaces are based on thermoplastic and/or thermoset binder systems. Examples which may be mentioned here are aminoplasts and binders based on acrylates.

EP-A-2192153 discloses binder systems based on crosslinked polycarboxylates and starch. EP-A-2987827 describes binder systems based on polyacrylates, wherein these are not crosslinked by means of a low molecular weight crosslinker, and starch. Further binder systems based on polyvinyl acetate and starch are known from EP-A-2607533. The binder systems described are already very well suited for the manufacture and consolidation of textile fabrics and have good heat resistance. For some applications, however, the wet strength and color stability should be improved. Furthermore, a reduction in binder costs is an important goal of binder development. In addition, the ever-increasing demand for binder systems which are predominantly based on renewable raw materials has to be met.

There is thus a considerable need for the provision of novel binder systems for consolidating textile surfaces which are intended to be used as inserts, which on the one hand satisfy the technical requirements and the legal provisions, and on the other hand are economically accessible. In addition, novel binder systems should be able to be used in existing production systems and applied by means of known methods and equipment. The novel binder systems should predominantly be based on renewable raw materials.

The object of the present invention is therefore to provide novel binder systems for consolidating textile surfaces, which on the one hand meet the technical requirements and the legal provisions, while on the other hand are economically accessible and additionally have improved color stability over a longer period of time. A further object is to be able to process the binder systems using known and established methods, so that investments can be kept low. A further object is to provide novel binder systems which are predominantly based on renewable raw materials, i.e., a minimum of 50% by weight, preferably a minimum of 70% by weight of the binder system (proportions by weight based on the dry mass of the binder system) should consist of naturally occurring and renewable raw materials.

An additional object of the present invention is to provide novel binder systems for consolidating textile surfaces which have a good and/or improved elongation at break, tensile strength, tear strength as well as a good thermal dimension stability (TDS).

Simultaneously, the novel binder systems provides for low moisture take-up during later storage which can cause problems in later handling, e.g. when producing bituminized sheets.

SUMMARY

The subject matter of the present invention is thus a textile fabric which is consolidated with a binder system comprising:

a) 0.1 to up to 30% by weight of polymers based on polyvinyl alcohol, and
b) at least 70% by weight of a mixture comprising:
  (i) at least one carbohydrate; and
  (ii) α-carbon nucleophile crosslinking agent that is an organic compound comprising:
    a first carbon moiety comprising an electron withdrawing group; and
    an α-carbon atom directly bonded to the first carbon moiety, the α-carbon atom has at least one acidic hydrogen atom and the α-carbon atom forms a nucleophile that reacts with a carbonyl carbon on the carbohydrate during polymerization of the binder composition to form the cured binder,
  wherein the mixture has a minimum of 50% by weight of reducing sugars,
c) 0 to 10% by weight of crosslinker, said crosslinker being different from the crosslinking agent (ii) above,
d) 0 to 10% by weight of fillers, said fillers being different from the polymers based on polyvinyl alcohol a) above and from the materials contained in the mixture b) above,
e) 0 to 10% by weight of additives, wherein the specifications regarding the proportions by weight are based on the dry mass of the binder system, i.e., without water, and the sum of the components a) to e) is 100% by weight.

In a further aspect of the present invention, the binder system used according to the invention comprises:

a) 0.1 to up to 30% by weight, preferably up to 20% by weight, in particular 1 to 20% by weight of polymers based on polyvinyl alcohol, and b) at least 70% by weight, preferably at least 80% by weight, in particular 99 to 80% by weight of a mixture comprising
   (i) at least one carbohydrate; and
   (ii) α-carbon nucleophile crosslinking agent that is an organic compound comprising:
      a first carbon moiety comprising an electron withdrawing group; and
      an α-carbon atom directly bonded to the first carbon moiety, the α-carbon atom has at least one acidic hydrogen atom and the α-carbon atom forms a nucleophile that reacts with a carbonyl carbon on the carbohydrate during polymerization of the binder composition to form the cured binder,
   wherein the mixture has a minimum of 50% by weight of reducing sugars, c) 0 to 10% by weight of crosslinker, d) 0 to 10% by weight of fillers, e) 0 to 10% by weight of additives, wherein the specifications regarding the proportions by weight are based on the dry mass of the binder system, i.e., without water, and the sum of the constituents a) to e) is 100% by weight, and its use for consolidating textile fabrics.

In a further aspect of the present invention, a method for consolidating textile fabrics by means of application of a binder system comprises:

a) 0.1 to up to 30% by weight, preferably up to 20% by weight, in particular 1 to 20% by weight of polymers based on polyvinyl alcohol, and b) at least 70% by weight, preferably at least 80% by weight, in particular 99 to 80% by weight of a mixture comprising
   (i) at least one carbohydrate; and
   (ii) α-carbon nucleophile crosslinking agent that is an organic compound comprising:
      a first carbon moiety comprising an electron withdrawing group; and
      an α-carbon atom directly bonded to the first carbon moiety, the α-carbon atom has at least one acidic hydrogen atom and the α-carbon atom forms a nucleophile that reacts with a carbonyl carbon on the carbohydrate during polymerization of the binder composition to form the cured binder,
   wherein the mixture has a minimum of 50% by weight of reducing sugars, c) 0 to 10% by weight of crosslinker, d) 0 to 10% by weight of fillers, e) 0 to 10% by weight of additives, wherein the specifications regarding the proportions by weight are based on the dry mass of the binder system, i.e., without water, and the sum of the constituents a) to e) is 100% by weight, onto a textile fabric and subsequent drying and curing of the binder system.

In a preferred embodiment of the present invention, the proportion of the component a) (polymers based on polyvinyl alcohol) is up to 25% by weight, in particular 1 to 20% by weight.

In a preferred embodiment of the present invention, the proportion of the component b) (carbohydrate) is at least 80% by weight, in particular 99 to 80% by weight.

In a preferred embodiment of the present invention, the mixture has a minimum of 50% by weight of reducing sugars, in particular preferred a minimum content of 70% by weight of reducing sugars In a further preferred embodiment, the sum of the components a) and b) is at least 80% by weight, in particular at least 85% by weight, more preferably at least 90% by weight.

In a further embodiment of the present invention, the proportion of the component c) (crosslinker) is at least 0.1% by weight.

After drying, the quantity of the binder system according to the invention applied to the textile fabric is preferably between 5 and 50% by weight of dry binder, in particular 10 and 30% by weight, particularly preferably 10 and 25% by weight of dry binder, based on the total weight of the raw textile fabric. For applications in the field of filtration products, the quantity applied after drying is preferably between 5 and 25% by weight.

Insofar as the binder system used according to the invention is to be used as an aqueous dispersion or solution, the viscosity is preferably 30 to 10000 mPa*s, in particular 40 to 5000 mPa*s, more preferably 50 to 2000 mPa*s.

The binder system used according to the invention can be present as true dispersions, colloidally disperse or molecularly disperse dispersions, but generally as so-called partial dispersions, i.e., aqueous systems, which are partially molecularly disperse and partly colloidally disperse.

BRIEF DESCRIPTION OF THE DRAWINGS

The Figure shows a graph of moisture update over time for different binder compositions.

DETAILED DESCRIPTION

The textile fabric consolidated by means of the binder system according to the invention has a high proportion of renewable ingredients without adversely affecting the mechanical properties of the consolidated textile fabric. The textile fabrics consolidated by means of the binder system according to the invention have good wet strength and excellent mechanical strength. The same applies to dimensional stability upon heating, which is also maintained despite exchanging significant proportions of component a) for components b). Despite the high proportion of component b), the brittleness of textile fabric consolidated by means of the binder system according to the invention is quite low.

Furthermore, the binder system according to the invention is surprisingly only slightly hygroscopic, so that no restrictions can be envisaged on using the consolidated textile fabrics as reinforcing inserts in the manufacture of PVC flooring, for example by blistering. Compared to binder systems based on polyvinyl alcohol and starch as renewable ingredient, the binder system according to the invention is less hygroscopic.

The aging behavior of the consolidated textile fabrics, which is almost constant, is also surprising.

In addition, it has been found that the binder system according to the invention allows for very good miscibility. The combination according to the invention of polymers based on polyvinyl alcohol and carbohydrate results in binder systems which have a high homogeneity. In particular, the aggregation of binder components which frequently occurs in binder mixtures based on renewable ingredients is avoided. This high homogeneity results in a good distribution of the binder system on and in the textile fabric during the application of the binder system, which in turn leads to very homogeneous properties of the consolidated textile fabric.

Compared with a textile fabric which exclusively has starch as the renewable binder component, the textile fabric consolidated according to the invention is improved or at least equivalent in terms of its hygroscopic behavior, strength, in particular wet and hot strength, brittleness, aging behavior and flexibility.

In addition, a completely formaldehyde-free binder system is obtained which, surprisingly, does not cause a deterioration in the product properties, in particular with respect to the mechanical properties of the textile fabric, such as, strength, for example.

For the person skilled in the art, it was surprising here that the binder system according to the invention can be applied to the textile fabric in a sufficiently high solids concentration. Hitherto, a person skilled in the art would have known that binder systems which comprise natural ingredients often cannot reach the required binder content of at least 15% or more by weight (binder content after drying, based on the total weight of the raw textile fabric) in a single application.

Accordingly, the binder system according to the invention preferably has a solids concentration of a minimum of 5% by weight, wherein the specifications regarding the proportions by weight are based on the dry mass of the binder system, i.e., without water, and the sum of constituents a) to e) is 100% by weight.

Binder Component a) (Polymers)

The polymers based on polyvinyl alcohol used as component a) according to the invention are commercially available polyvinyl alcohols which have a degree of saponification of 80-99%. Fully saponified polyvinyl alcohols may also be used.

The polymers based on polyvinyl alcohol used according to the invention can have up to 5 mol % of other comonomer units, for example monomer units based on ethylene so that, in addition to the polyvinyl alcohol homopolymers, co- or terpolymers are also included. The polymers based on polyvinyl alcohols used according to the invention are preferably homopolymers.

The polymers based on polyvinyl alcohol used according to the invention are commercially available, for example, from Kuraray under the name POVAL® or Mowiol®.

The polymers based on polyvinyl alcohol used according to the invention can be mixed with the carbohydrate as an aqueous dispersion or solution, or even in powder form. The components can be pre-mixed individually or together in water and heated to a temperature below the boiling point of water, e.g., 70-95° C., and adjusted with regard to the viscosity. The binder system is then adjusted to the application temperature, i.e., heated or cooled as required.

Insofar as component a) of the binder system according to the invention is to be used as an aqueous polymer dispersion, conventional and known emulsifiers or protective colloids can be added for stabilization. These are known to a person skilled in the art (cf. Houben-Weyl, Methoden der org. Chemie [Methods in Organic Chemistry], Vol. XIV/1, 1961, Stuttgart). Examples of emulsifiers are polyglycol ethers, fatty alcohol polyglycol ethers, phosphoric acid esters and their salts, sulfonated paraffin hydrocarbons, higher alkyl sulfates (e.g., lauryl sulfate), alkali metal salts of fatty acids such as sodium stearate or sodium oleate, sulfuric acid half-esters of ethoxylated fatty acid alcohols, salts of esters and half-esters of alkylpolyoxyethylene sulfosuccinates, salts of sulfonated alkylaromatics such as, for example, sodium dodecylbenzenesulfonate, ethoxylated C4-C12 alkylphenols and their sulfonation products, and esters of sulfosuccinic acid. Examples of protective colloids are alkylhydroxyalkylcelluloses, partially or fully hydrolyzed polyvinyl alcohols and copolymers thereof, acrylic acid, homo- and copolymers and partially neutralized salts thereof, acrylamide copolymers, polyacrylate copolymers and salts thereof, carboxyalkylcellulose, such as carboxymethylcellulose and salts thereof.

In addition, component a) can be present as true dispersions, colloidally disperse or molecularly disperse dispersions, but in general as so-called partial dispersions, i.e., aqueous systems which are partially molecularly disperse and partly colloidally disperse.

Insofar as component a) of the binder system according to the invention is to be used as an aqueous polymer dispersion or polymer solution, the solids content is preferably between 5-30% by weight, in particular between 5 and 20% by weight, particularly preferably 7 to 15% by weight Insofar as the component a) of the binder system according to the invention is to be used as an aqueous polymer dispersion, the viscosity is preferably from 30 to 10000 mPa*s, in particular from 40 to 5000 mPa*s, more preferably from 50 to 2000 mPa*s.

Insofar as the component a) of the binder system according to the invention is to be used as an aqueous polymer dispersion, the pH (measured as a 10% by weight solution in water) is between 4 and 8, preferably between 4.5 and 7.0.

In a preferred embodiment of the invention, the binder system according to the invention essentially comprises no additional polyacrylate dispersion based on acrylic acid and/or modified acrylic acid, especially methacrylic acid, monomers, as well as maleic acid/maleic anhydride and/or styrene maleic anhydride (SMA). In this context, "essentially" means that up to 10% by weight of the polyvinyl alcohol is replaced by polyacrylates, wherein the total quantity of components a) remains unchanged. The binder system according to the invention particularly preferably comprises essentially no additional polyacrylate dispersion.

In a preferred embodiment of the invention, the binder system according to the invention essentially comprises no additional polyvinyl acetate dispersions. In this context, "essentially" means that up to 10% by weight of the polyvinyl alcohol is replaced by polyvinyl acetate, wherein the total quantity of components a) remains unchanged. The binder system according to the invention particularly preferably comprises essentially no additional polyvinylacetate dispersion.

Binder Component B) (Alpha Binder)

According to the instant invention, mixture b) forming at least 70% by weight of the binder system comprises at least one carbohydrate and at least a crosslinking agent that is an organic compound.

Carbohydrate based binder system often undergo the Maillard reaction which is not desired, e.g. due to color changes. In order to avoid any such disadvantages, replacing the conventional nitrogen nucleophile in Maillard-type binder compositions with an α-carbon nucleophile that reacts with the carbonyl carbon on a reducing sugar carbohydrate results in binder not having the aforementioned disadvantages. Thus, mixtures of α-carbon nucleophile that reacts with the carbonyl carbon on a reducing sugar carbohydrate are so-called α-binder systems.

The carbohydrate used in the α-binder mixture b) according to the invention are not subject to any restrictions, but they must be compatible with the component a) and, if appropriate, with components c), d) and e). However, the mixture has a minimum of 50% by weight of reducing sugars.

The α-carbon nucleophile crosslinking agent that is an organic compound, comprises:

a first carbon moiety comprising an electron withdrawing group; and an α-carbon atom directly bonded to the first carbon moiety, the α-carbon atom has at least one acidic hydrogen atom and the α-carbon atom forms a nucleophile that reacts with a carbonyl carbon on the carbohydrate during polymerization of the binder composition to form the cured binder, and is also referred to as α-binder.

In the crosslinking agent, the α-carbon on the crosslinking agent has at least one acidic hydrogen atom (a.k.a. "active" hydrogen atom) that can dissociate from the α-carbon as a proton (H+) to leave behind a highly reactive, activated crosslinking agent. In many instances, the activated crosslinking agent has α-carbon nucleophile that reacts with a carbonyl carbon on a nearby carbohydrate to initiate the curing of the binder composition. In additional instances, an α-carbon nucleophile is formed in the reaction product of the activated crosslinking agent and the carbohydrate, which may go on to further reactions during binder curing. The curing may proceed through a series of addition and condensation reactions (among other reaction types) until the cured carbohydrate binder is finally formed.

In the present application, an α-carbon nucleophile crosslinking agent means an organic compound having an α-carbon which refers to an carbon atom directly bonded to an adjacent carbon atom which is bonded to an electron withdrawing group ("EWG"). For example, when the EWG is a double bonded oxygen (O═) bonded to a carbonyl carbon, an α-carbon is an adjacent carbon atom directly bonded to the carbonyl carbon. If the carbonyl carbon is part of an aldehyde functional group, then there is only one α-carbon bonded adjacent to the carbonyl carbon. However, if the carbonyl carbon is part of a ketone functional group, then there are two α-carbons bonded directly to the carbonyl carbon.

In some examples of the present crosslinking agents, an α-carbon may also be directly bonded to an EWG, or some other moiety besides hydrogen and/or carbon. For example, the when the crosslinking agent is glyoxal, there are aldehyde functional groups directly bonded at the carbon atoms as shown in chemical structure (I):

(I)

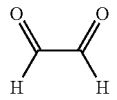

Glyoxal

Each of the carbon atoms in glyoxal is an α-carbon that is also a carbonyl carbon. The glyoxal carbons get their α-carbon character by being bonded to an acidic α-hydrogen that undergo proton dissociation to leave behind an activated crosslinking agent. Thus, glyoxal provides an example of a crosslinking agent having an α-carbon (more precisely two α-carbons) that is directly bonded to an EWG. Additional description of the present crosslinking agents is provided below.

As noted above, the present crosslinking agents are organic compounds that have a first carbon moiety bonded to both an electron withdrawing group ("EWG") and at least one α-carbon that has at least one acidic hydrogen (which may also be referred to as a α-hydrogen or an active hydrogen). When the acidic hydrogen deprotonates from the crosslinking agent, a highly reactive α-carbon nucleophile may form.

Preferably, the α-carbon nucleophile crosslinking agent according to the instant invention can be described by the formula (II)

Formula (II)

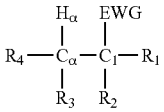

In which

EWG means a double bonded oxygen atom (O═) that forms a carbonyl group with the adjacent carbon atom $C_1$, a nitrile group (N═C—), a nitro group ($O_2N$—), a halogen group (e.g. (F—), (Cl—), (Br—), (I—)); or an oxyhalogen group, $R_1$ and $R_2$ independently be a hydrogen, an alkyl group, an aromatic group, a hydroxyl group, or an alkoxy group, with the proviso that when the EWG is a double bonded oxygen atom (O═), then either $R_1$ or $R_2$ is not present to maintain the quadravalency of the $C_1$ carbon and $R_1$ may be a hydrogen atom and $R_2$ is not present to make the $C_1$ moiety an aldehyde group or $R_1$ may be an alkyl group, preferably a methyl group, and $R_2$ is not present to make the $C_1$ moiety a ketone group, $R_3$ and $R_4$ independently be a hydrogen, an alkyl group, an aromatic group, a hydroxyl group, or an alkoxy group, or $R_3$ or $R_4$ is a double bonded oxygen atom (O═), then either $R_3$ or $R_4$ are not present to maintain the quadravalency of the C carbon.

Structure (IIa) shows a generic crosslinking agent having an α-carbon (Cα) adjacent to a carbon (C1) bonded to an EWG. The α-carbon shown in structure (IIa) is bonded to at least one acidic hydrogen (Hα) that can deprotonate from the crosslinking agent. Structures (IIb) and (IIc) show two forms of the α-carbon nucleophile that depend on whether the binder curing is base-catalyzed (IIb) or acid-catalyzed (IIc). The base-catalyzed α-carbon nucleophile (IIb) simply requires a base (e.g. a hydroxyl group) to facilitate the deprotonation of the α-carbon to form a α-carbanion nucleophile. The acid-catalyzed nucleophile (IIc) facilitates the formation of a carbocation at C1 which in turn facilitates the deprotonation of the α-hydrogen (Hα) and formation of a double bond between the Cα and C1 carbons. The C═C group acts as a nucleophile for nucleophilic addition with nearby carbonyl carbons on the carbohydrates, and is referred to here as an α-carbon nucleophile.

(IIa)

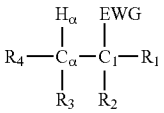

(IIb)

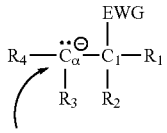

Nucleophile

-continued (IIc)

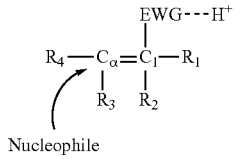

Examples of the EWG in structures (IIa)-(IIc) may include a double bonded oxygen atom (O═) that forms a carbonyl group with the adjacent carbon atom $C_1$. In additional examples, the EWG may be a nitrile group (N≡C—), a nitro group ($O_2N$—), a halogen group (e.g. (F—), (Cl—), (Br—), (I—)); or an oxyhalogen group, among other types of EWGs. The $C_1$ carbon is covalently bonded to at least one adjacent α-carbon ($C_\alpha$) that is bonded to at least one acidic α-hydrogen ($H_\alpha$).

The $R_1$ and $R_2$ may independently be a hydrogen, an alkyl group, an aromatic group, a hydroxyl group, or an alkoxy group, among other groups. When the EWG is a double bonded oxygen atom (O═), then either $R_1$ or $R_2$ are not present to maintain the quadravalency of the $C_1$ carbon. For example, $R_1$ may be a hydrogen atom and $R_2$ is not present to make the $C_1$ moiety an aldehyde group. Alternatively, $R_1$ may be an alkyl group (e.g. methyl group) and $R_2$ is not present to make the $C_1$ moiety a ketone group. Structure (IId) shows a generic crosslinker with an aldehyde group, and structure (IIe) shows a generic crosslinker with a ketone group.

(IId)

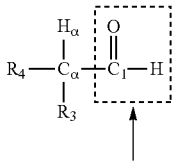

(IIe)

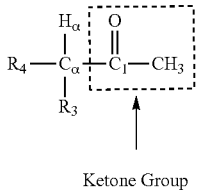

In additional examples where the EWG is a double bonded oxygen (O═), either the $R_1$ or $R_2$ group may be a hydroxyl group (HO—) or an alkoxy group (RO—). When the $R_1$ or $R_2$ group is a hydroxyl group (HO—) the $C_1$ moiety is an organic acid group, and when the $R_1$ or $R_2$ group is an alkoxy group (RO—) the $C_1$ moiety is an ester group.

The $R_3$ and $R_4$ groups bonded to the α-carbon ($C_\alpha$) may be a hydrogen, or a hydrocarbon group such as a substituted or unsubstituted alkyl group, aromatic group, or olefinic group, among other hydrocarbon groups. When the $R_3$, and/or $R_4$ groups are hydrogen, then the α-carbon ($C_\alpha$) has multiple acidic α-hydrogens.

As noted above in the discussion of glyoxal, examples of crosslinking agents can also have an electron withdrawing group as the $R_3$, and/or $R_4$ group. For glyoxal, $R_3$ or $R_4$ is a double bonded oxygen moiety like the EWG bonded to $C_1$. In this situation both $C_\alpha$ and $C_1$ act as α-carbons, each bonded to an acidic hydrogen that can dissociate to form an activated crosslinking agent.

When an α-carbon on the crosslinking agent is bonded to more than one acidic hydrogen, it may crosslink an equivalent number of carbohydrate molecules to the α-carbon.

Reaction scheme (III) below, for example, shows an EWG, such as a carbonyl carbon of an aldehyde or ketone, bonded to an α-carbon with multiple acidic hydrogens. As the first hydrogen dissociates from the α-carbon it becomes an α-carbon nucleophile that attacks the carbonyl carbon on a nearby carbohydrate, shown here as dextrose. The reaction product has the α-carbon bonded to the first dextrose unit, but also bonded to a second hydrogen that continues to be acidic due to the electrophilic character of the adjacent carbon bonded to the EWG. When the second hydrogen dissociates from the α-carbon nucleophile it again becomes an α-carbon nucleophile capable of reacting with a second carbonyl carbon on a second nearby dextrose unit. Thus, a single α-carbon on the crosslinking agent can crosslink two carbohydrate molecules:

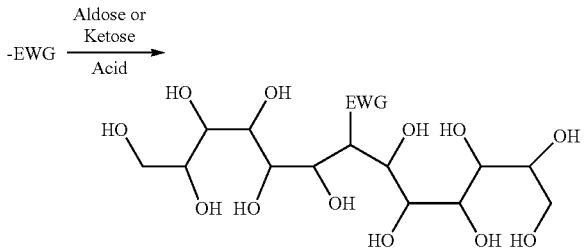

(III)

In reaction scheme (III) the α-carbon addition reaction to the dextrose units is catalyzed by an acid catalyst. Catalytic protons first combine with the EWG to form a cation that eventually forms the α-carbon nucleophile through acid-catalyzed tautomerization. Alternatively, the α-carbon nucleophile may be formed from a based-catalyzed dissociation of an acidic α-hydrogen directly from the α-carbon. Exemplary acid and base catalysts are described below.

In reaction scheme (III) the crosslinking agent had a single EWG. Reaction scheme (IV) below uses glyoxal in the binder composition and shows an example of a crosslinking agent with two EWGs which also happen to be bonded to the α-carbons. While not wishing to be bound to a particular reaction mechanism, it is believed the binder curing scheme for glyoxal and dextrose starts with an acid-catalyzed activation of the glyoxal to remove an acidic proton from one of the α-carbons. The activated glyoxal then reacts with the carbonyl carbon on the dextrose to make a reaction product with a new α-carbon attached to a hydroxyl group formed from the carbonyl oxygen of the dextrose. Under the acid catalysis conditions of the binder composition, the hydroxyl group leaves to form a water molecule and the carbocation left behind on the reaction product undergoes a tautomerizaton with an adjacent hydroxyl group to form the new α-carbon and another carbonyl group. The new α-carbon can react with another nearby dextrose carbonyl group to extend the growing glyoxal-dextrose polymer.

As shown in reaction scheme (IVa), the glyoxal moiety on the glyoxal/dextrose reaction product still has a second α-carbon available for reactions. In one possible scenario the α-carbon can react with a carbonyl carbon on another dextrose molecule to further grow the glyoxal-dextrose polymer through a series of addition and condensation reactions like those shown in reaction scheme (IVa). It should be appreciated that a wide variety of growth pathways are available for the continued polymerization of the glyoxal and dextrose binder composition as it forms the cured, thermoset binder. Reaction scheme (IVa) is a simplified rendering of one of those possible pathways.

(IVa)
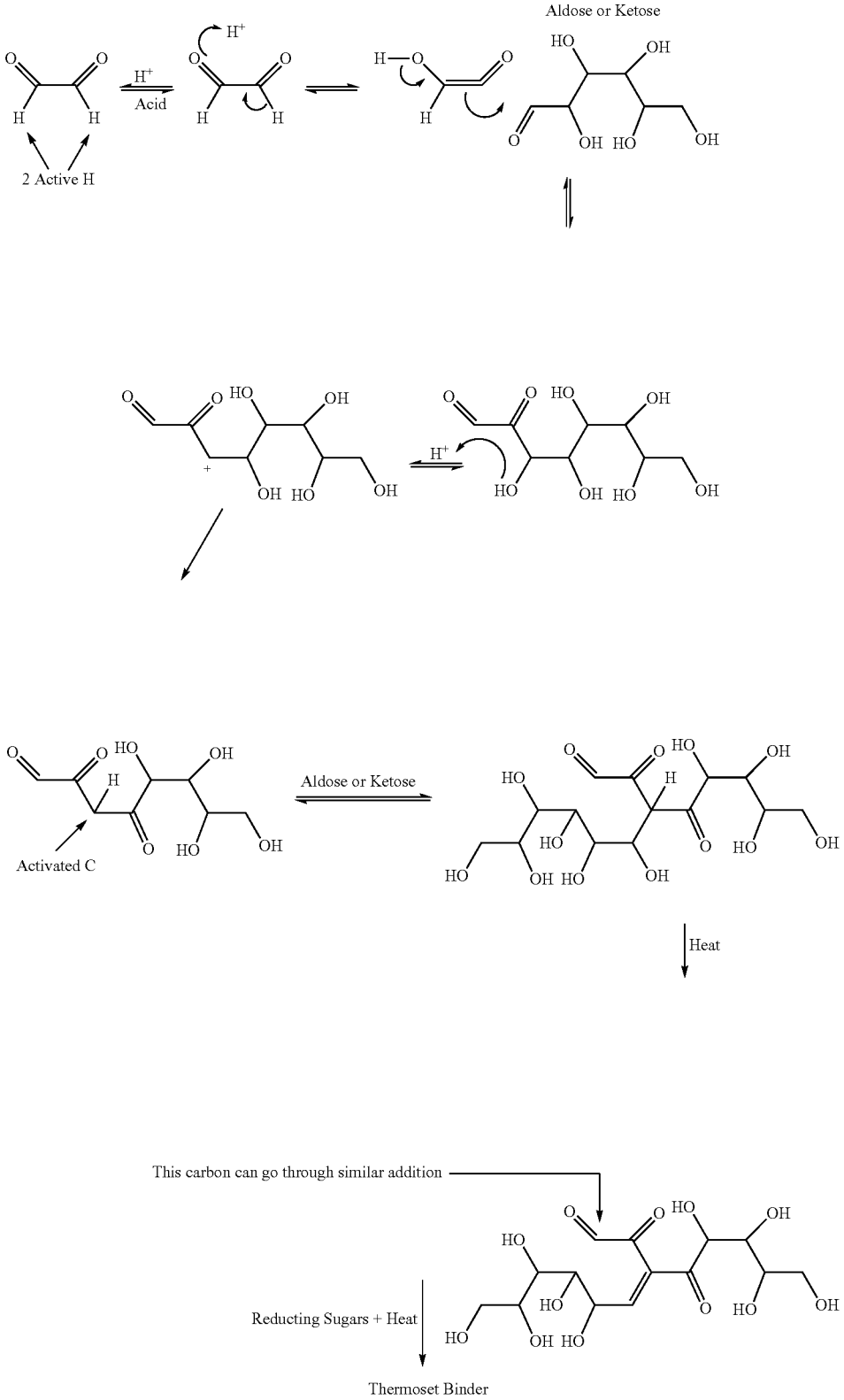

Reaction scheme (IVb) shows two possible pathways (Path 1 and 2) for continued reactions of the glyoxal-dextrose composition. Path 1 shows an internal condensation reaction between a carbonyl oxygen and hydroxyl group to form a heterocyclic furfuryl alcohol ring that can undergo further crosslinking reactions. Path 2 shows another internal condensation reaction that forms a heterocyclic lactone alcohol ring also capable of further crosslinking reactions:

(IVb)

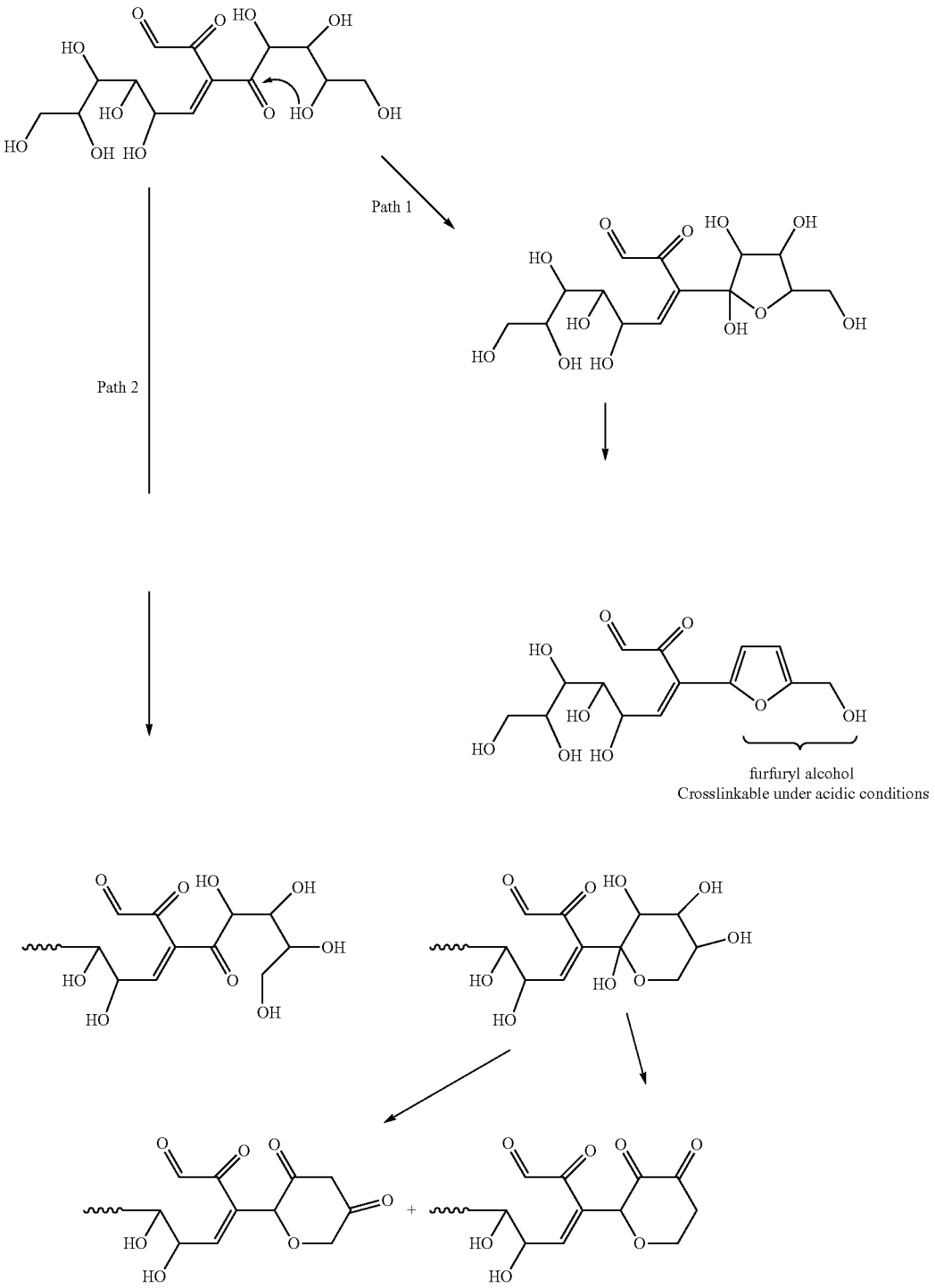

The products shown in both pathways are able to further react with additional dextrose molecules and/or other glyoxal-dextrose reaction products to further the polymerization of these products as the binder cure continues. The reaction of the α-carbon nucleophile of a glyoxal/dextrose reaction product and another carbonyl carbon on a second dextrose molecule is called an aldol addition reaction. An aldol addition normally retains the carbonyl carbon from the nucleophile (in this case the crosslinking agent) and forms a hydroxyl group at a β-carbon position two carbon atoms away from the carbonyl carbon. It is common for the aldol addition product to subsequently undergo an aldol condensation that removes a proton from the α-carbon and the hydroxyl group from the β-carbon to leave an olefinic condensation product. In some instances the aldol condensation may be the final step in the polymerization of the carbohydrates and crosslinking agents, while at other times the condensation occurs before the final polymerization stage.

It should be appreciated that the pathways shown in reaction scheme (IVb) are just two of a larger group of possible pathways for the polymerization of the glyoxal and dextrose to form the cured, thermoset binder. All of these pathways reflect the fact that glyoxal has two α-carbons that can each react with the carbonyl carbon on dextrose molecules to produce polymer intermediates that can form additional α-carbons for reaction with still more dextrose molecules. As these intermediates grow in size and complexity, more internal condensation reactions occur until eventually the final cured thermoset binder is formed.

The glyoxal crosslinking agent described above is just one example of a larger class of crosslinking agents having a plurality of aldehyde and/or ketone functional groups. This larger class includes polyaldehydes (e.g. dialdehydes), polyketones (e.g. diketones), and compounds that have at least one aldehyde group and at least one ketone group.

Examples include α,β-bicarbonyl compounds where carbonyl carbons are directly bonded as illustrated in the following generic structure (V):

(V)

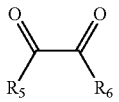

where $R_5$ and $R_6$ are independently chosen from a hydrogen moiety (H), an alkyl group, or an aromatic group. Exemplary α,β-carbonyl compounds include gloxyal, diacetyl, and benzil 1,2-diphenylethane-1,2-dione).

Examples further include α,γ-bicarbonyl compounds where the carbonyl carbons are separated by one carbon atom as illustrated in the following generic structure (VI):

(VI)

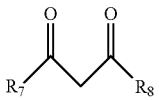

wherein $R_7$ and $R_8$ are independently chosen from a hydrogen moiety (H), an alkyl group, or an aromatic group. Exemplary α,γ-bicarbonyl compounds include malondialdehyde, 1,3-propanedial, and acetylacetone, among others. In additional examples, more carbons may separate the two carbonyl groups. These include crosslinking agents having the general formula $R_7(O{=}C)—(CH_2)_x—(C{=}O)R_8$, where x is an integer ranging from 2 to 8.

Examples of the these crosslinking agents include dialdehydes such as 1,4-butanedial, glutaraldehyde, 1,5-pentanedial, 1,6-hexanedial, etc. When $R_7$ and/or $R_8$ is an alkyl group, they also include aldehyde-ketone compounds and diketones. Examples of these crosslinking agents include 2,3-butanedione, 2,4-pentanedione (a.k.a. acetylacetone), and quinones, among others.

In some instances, the $R_7$ and $R_8$ groups may independently also include alkoxide groups (—OR) where R represents an alkyl group. For example, the α,γ-bicarbonyl compounds may include malonic acid esters having generic structure (VII):

(VII)

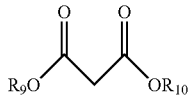

where $R_9$ and $R_{10}$ are independently an alkyl group or an aromatic group.

Additional examples of α,γ-bicarbonyl compounds may further include those with alkoxy moieties such as those illustrated in generic structure (VIII):

(VIII)

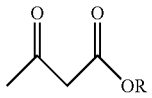

where R represents an alkyl group.

While many of the carbonyl-containing crosslinking agents above have two or more carbonyl groups, crosslinking agents with a single carbonyl group may also used in the present binder compositions. These may include aldehydes and ketones. esters, and organic acids. Exemplary aldehydes include ethanal, propanal, etc. Exemplary ketones include, acetone, and methyl ethyl ketone (MEK), among others.

As noted above, carbonyl-containing EWGs may also include esters and organic acids having one or more of these functional groups. Exemplary esters include dialkyl malonates, alkyl acetates, polyesters, polyacrylates, aceto-acetate esters, and cyano-acetate esters. Exemplary organic acids may include acetic acid, propionic acid, malonic acid, and polyacrylic acid, among other types of acids. They may also include crosslinking agents with mixed functional groups, such as cyano-acetic acid.

As noted above, EWGs other than a double bonded oxygen atom (O=) to form a carbonyl carbon may be used in the present binder composition. For example nitrogen-containing EWGs such as a nitrile group (N≡C—), or a nitro group ($O_2N$—) may be the EWG bonded to the carbon adjacent to the α-carbon. These nitrogen-containing EWGs are electrophilic in character and therefore do not participate as nitrogen nucleophiles in Maillard reactions with the carbohydrates. Thus, even though the binder composition (and the cured binder of the present fiber-containing composite) may include certain nitrogen-containing compounds, these compounds do not undergo Maillard reactions to any appreciable extent, and the cured binder does not contain significant (or any) amount of melanoidins.

The instant new and inventive binder composition to be cured does not contain any urea and/or compounds having a primary or secondary amine or ammonium group or compounds forming urea and/or compounds having a primary or secondary amine or/ammonium group during curing of the binder composition as part of the crosslinking agent or as further component of the binder composition. Tertiary amines may be present, because they are not participating in the Maillard reaction. Thus the cured binder of the present fiber-containing composite does not contain any melanoidins formed from said binder composition. To such extent base catalysts are used as catalyst and such basic catalyst include alkaline nitrogen compounds and/or amines, minor amounts of melanoidins can be formed. However, such melanoidins are only formed from such basic catalyst and are considered not being significant. Thus, the instant new and inventive binder composition after curing does not contain significant (or any) amount of melanoidins. The term significant within the meaning of the aforementioned refers to the instant new and inventive binder composition after curing having not more than 3 wt. %, preferable not more 1 wt. % of melanoidins, based on the total amount of cured binder being present.

Exemplary crosslinking agents having a nitrogen group include nitrile compounds such as acetonitrile, propionitrile, butyronitrile, pentanenitrile, hexanenitrile, and higher nitriles, among other nitrile compounds. They also include polynitriles such as 1,3-dinitriles, malonitrile (methan-dinitrile), adiponitrile, hexanedinitrile, polyacrylonitrile, and acrylonitrile compolymers, among other polynitrile compounds. They further include nitro compounds such as nitromethane, nitroethane, nitropropane, nitrobutane, nitropentane, nitrohexane, among other nitroalkyl compounds. They still further include 1,3-cyano-esters, cyano-acetic acid, and cyano-acetic esters, among other cyano compounds.

Exemplary crosslinking agents may also include sulfur-containing EWGs. These exemplary sulfur-containing crosslinking agents may include a sulfoxide functional group, or sulfone functional groups, among other types of sulfur-containing groups. Specific examples of these exemplary crosslinking agents include dimethyl sulfoxide (DMSO) and dimethyl sulfone. Crosslinking agents with phosphorous-containing EWG may also be used. These exemplary crosslinking agents may include phosphoxide functional groups such as alkyl phosphoxides (e.g. trimethyl phosphoxide).

Exemplary concentration ranges (by dry weight) of the crosslinking agent in the binder composition may include about 1 wt. % to about 50 wt. %. More specific ranges include about 5 wt. % to about 25 wt. %; and about 10 wt. % to about 20 wt. %, among others. Specific exemplary concentrations (by dry weight) for the crosslinking agent in the binder composition include about 5 wt. %, about 10 wt. %, about 15 wt. %, about 20 wt. %, and about 25 wt. %, among other concentrations.

The carbohydrate used in the binder composition includes a reducing sugar having an aldehyde or ketone group that is capable of isomerizing to produce an aldehyde group. Exemplary reducing sugars include monosaccharaides such as glucoses (e.g. dextrose), fructose, glyceraldehyde, and galactose. They also include polysaccharides such as lactose, maltose, xylose, and amylose, among others. The binder compositions may include a single reducing sugar or a combination of two or more reducing sugars as the reducing sugars in the composition. However, the mixture has a minimum of 50% by weight of reducing sugars as carbohydrate component.

The carbohydrate may also include larger polysaccharides (e.g. hydrolysable polysaccharides), modified sugars, celluloses, modified celluloses, and dextrins (e.g. cyclodextrins and maltodextrins). For the larger polysaccharides that are non-reducing because they lack an accessible aldehyde or ketone group, reducing sugars may be generated in situ under the elevated temperatures of the curing binder composition. For example, dextrin may hydrolyze in situ under curing conditions to provide one or more dextrose molecules that react with the crosslinking agent. Alternatively, the binder composition carbohydrate may include exclusively reducing sugars, or exclude one or more type of non-reducing carbohydrate. For example, the binder composition may lack one or more of starch, modified starch, cellulose, modified cellulose, and dextrin.

The molar ratio of the (1) crosslinking agent to (2) the reducing sugar generally ranges from 1:2 to 1:50. Exemplary ratios of crosslinking agent to reducing sugar include a range from 1:4 to 1:10. The tensile strength of the composites typically peak at 4 to 8 moles of dextrose normalized for 1 mole of the crosslinking agent. This translates into a peak tensile strength at (crosslinking agent): (reducing sugar) mole ratios between 1:4 and 1:8.

The tensile strength shows no significant increases for higher relative moles of the dextrose relative to the glyoxal crosslinking agent.

The carbohydrate used in the binder composition have advantageously sufficient cold solubility and/or hot solubility.

Reactions between the α-carbon-containing crosslinking agent and carbohydrate may be catalyzed by either acid catalysts or base catalysts. While the catalysis mechanism differs for each class of catalyst, the end result for both is to lower the activation barrier for the formation of an α-carbon nucleophile on the crosslinking agent that reacts with a carbonyl carbon on the carbohydrate.

As noted above, forming an α-carbon nucleophile using an acid catalyst usually includes protonating the EWG to facilitate the formation of a carbocation that in turn causes the deprotonation of the α-carbon and formation of a C=C double bond. The C=C bond can act as the α-carbon nucleophile in addition reactions between the crosslinking agent and a carbonyl carbon on a nearby reducing sugar. For example, when the EWG is a double bonded oxygen that forms a carbonyl functional group, the acid catalyst protonates the oxygen atom, which facilitates the formation of a carbocation at the carbonyl carbon that then tautomerizes into an enol group with the α-carbon. The C=C double bond of the enol group acts as the α-carbon nucleophile.

Exemplary acid catalysts may include organic acids (e.g. acetic acid, citric acid, maleic acid, poly acrylic acid). It has been found that a particular preference is given to organic acids which are preferably present in the binder composition at 0.1-1.0 mole per mole of reducing sugar. Within the aforementioned organic acids, citric acid is most preferred. The optimum level of citric acid per reducing sugar was found at 0.1 to 0.5 mole citric acid to reducing sugar. This embodiment further improves the mechanical performance of the cured fibrous composite. Suitable catalysts may also include inorganic acids organically modified inorganic acids such as sulfuric acid; alkyl sulfonic acids (e.g. methyl sulfonic acid, ethyl sulfonic acid, etc.); aryl sulfonic acid (e.g. p-toluene sulfonic acid); sulfamic acid; alkyl sulfamic acids (e.g. methyl sulfamic acid, ethyl sulfamic acid, etc.); phosphoric acid; alkyl phosphonic acids (e.g. methyl phosphonic acid, ethyl phosphonic acid, etc.); aryl phosphonic acids (e.g. p-toluene phosphonic acid); hypophosphorous acid; and nitric acid, among other inorganic acids and organically modified inorganic acids. They may also include acidic salts of the above described acids, including alkali metal salts, alkali earth metal salts, and transition metal salts. Exemplary acid catalysts may further include Lewis acids such as iron chloride ($FeCl_3$) and aluminum chloride ($AlCl_3$), among other Lewis acid catalysts.

Forming an α-carbon nucleophile using a base catalyst usually involves the simple deprotonation of the acidic hydrogen on the α-carbon to form a nucleophilic α-carbanion. The α-carbanion a highly reactive α-carbon nucleophile that reacts with carbonyl carbons on nearby carbohydrate molecules in the binder composition.

Exemplary base catalysts (also called alkaline catalysts) may include alkali metal hydroxides (e.g. sodium hydroxide, potassium hydroxide, etc.) and alkali earth metal hydroxides (e.g. magnesium hydroxide, calcium hydroxide, etc.). They may also include alkaline nitrogen compounds such as ammonia (e.g. ammonium hydroxide) and amines for binder formulations that can tolerate the presence some Maillard-type reactions with the α-carbon nucleophile reactions. In many instances however, nucleophilic amines and ammonium ions will dominate the reaction with the carbonyl carbons of the carbohydrates and effectively turn the cured binder into a Maillard-type binder. If the specification for the final fiber-containing composite calls for limiting or eliminating melanoidins in the cured binder, ammonium and amine compounds should be limited to tertiary amines which lack an acidic proton that can be removed to from an amine nucleophile. Exemplary tertiary amines include trialkyl amines (e.g. triethyl amine, 1,4-diazabicyclo[2.2.2]octane (DABCO)), and trialkoxy amines (e.g. triethanol amine).

Exemplary concentrations of the catalyst (or combination of catalysts) in the binder composition may have a range from about 1 wt. % to about 20 wt. % of the composition. For example, the catalyst concentration may range from about 1%, 2%, 3%, 4%, 5%, 6%, 7%, etc., on the low end, and 10%, 11%, 12%, 13%, 14%, 15%, 16%, 17%, 18%, 19%, or 20 wt. % on the high end. Exemplary catalyst concentrations may include about 5 wt. %, about 7.5 wt. %, about 8 wt. %, about 9 wt. %, about 10 wt. %, and about 15 wt. % among other concentrations. Additional exemplary concentration ranges for the catalyst concentration include about 5 wt. % to about 15 wt. % based on the dry weight of the binder composition.

The pH of the present binder compositions may vary depending upon the types and relative concentrations of the components used. Typically the pH of the present binder compositions range from acidic to alkaline. An exemplary acidic pHs for the binder composition include about 4 or less; about 3 to about 5; among others. An exemplary alkaline pH for the binder composition is about 9 to about 12 (e.g. about 8 to about 10). Additional exemplary pH ranges can span from acidic to alkaline such as about 2 to 9 (e.g. 4 to 8). The pH range of the binder composition may be different when the catalyst is added to the composition. For example, the binder composition may have a pH range of about 2 to about 9 before the catalyst addition and a pH range of about 0 to about 12 after the catalyst addition. In another example, the pH range be about 2 to about 7 before the catalyst addition and about 0 to about 10 after the catalyst addition.

Binder Component C) (Crosslinker)

The binder system used according to the invention can also contain up to 10% by weight of crosslinker. The crosslinker is different, preferably different in chemical structure, from the crosslinking agent (ii) above, also referred to as the α-binder.

The crosslinkers used as component c) according to the invention are synthetic resins based on urea-formaldehyde (UF), melamine-formaldehyde (MF) or mixtures (MUF).

In addition, the following substances are also suitable as component c):

- polyisocyanate compounds, for example tolylene diisocyanate, hydrogenated tolylene diisocyanate, adducts of trimethylolpropane and tolylene diisocyanate, triphenylmethane triisocyanate, methylenebis (4-phenylmethane) triisocyanate, isophorone diisocyanate, their reaction products with ketoxime or phenol;
- polyaldehydes, for example glyoxal, succindialdehyde, malonaldehyde, maleic acid dialdehyde, phthalic acid dialdehyde, glutaric acid aldehyde, adipaldehyde;
- polyepoxy compounds, for example ethylene glycol diglycidyl ether, polyethylene glycol diglycidyl ether, glycerol diglycidyl ether, glycerol triglycidyl ether, 1,6-hexanediol diglycidyl ether, trimethylolpropane triglycidyl ether, diglycidylaniline, diglycidylamine;
- polyamine compounds, for example urea, melamine, methylolurea, methylolmelamine, hexamethylenediamine, triethanolamine;
- compounds which can form a radical, for example, hydrogen peroxide, potassium peroxodisulfate, ammonium persulfate, benzoyl peroxide, succinic acid peroxide, t-butyl peroxymaleate, benzoin alkyl ethers, e.g., t-butyl hydroperoxide benzoin methyl ether, benzoin ethyl ether and benzoin isopropyl ether, organic sulfur compounds such as dibutylsulfide, benzylsulfide and decylphenylsulfide, a diazonium salt and a triazonium salt, their double salts with zinc chloride or its condensation product, azobisisobutyronitrile, 2,2'-azobis (2-amidinopropane) dihydrochloride, dyes such as, e.g., methylene blue or a combination of the p-toluenesulfonate ion with it, a pyrylium salt, a thiapyrylium salt, ammonium dichromate, acetophenone, benzophenone, benzil, phenanthrene, thioxanthone, dichloropropylphenyl ketone, anthraquinone, 2-chloroanthraquinone, 2-bromoanthraquinone, sodium anthraquinone β-sulfonate, 1,5-dinitro anthraquinone, 1,2-benzanthraquinone, phenanthrenequinone, 5-benzoylacetonaphthene, 5-nitroacetoneaphthene, 1,4-naphthoquinone, 1,8-phthaloylnaphthalene, 2-nitrofluorene, p-nitroaniline, picramide;
- oxidizing agents, for example potassium dichromate, ammonium dichromate, calcium perchlorate;
- polymerizable monomers, for example 2-hydroxyethyl acrylate, 2-hydroxyethyl methacrylate, 2-hydroxypropylacrylate, 2-hydroxypropyl methacrylate, N-vinylpyrrolidone, 2-hydroxyethylacryloylphosphate, acrylamide, methacrylamide, N-methylolacrylamide, N-methylolmethacrylamide, N-methoxymethylacrylamide, N-ethoxy-methylacrylamide, ethylene glycol monoacrylate, dipropylene glycol monoacrylate, N,N-dimethylaminoethylacrylate, styrene, vinyltoluene, monochlorostyrene, diallylphthalate, vinyl acetate, glycidyl methacrylate;
- salts of polyvalent metals, for example a chloride, bromide, nitrate, sulfate or acetate of a polyvalent metal such as aluminum, iron, copper, zinc, tin, titanium, nickel, antimony, magnesium, vanadium, chromium or zirconium, in particular copper (II) chloride, aluminum chloride, iron (Ill) chloride, tin (IV) chloride, zinc chloride, nickel (II) chloride, magnesium chloride, aluminum sulfate, copper (II) acetate, chromium acetate and the like. However, the crosslinkers which can be used according to the invention are not limited to the aforementioned examples.

Suitable crosslinkers are, for example, Polycup 9200 polyamide epichlorohydrin, Encor 3875 (polyacrylic acid with sodium hypophosphite catalyst) and ammonium zirconium carbonate.

Alkali metal hypophosphites and alkali metal phosphite catalysts are particularly suitable.

The catalyst is preferably an alkali/alkaline earth phosphinate; Na phosphinate is particularly preferred as a catalyst.

The presence of the catalyst causes the crosslinking reaction between OH groups of the carbohydrate that is present and the carboxylic acid from the polymers that is present to be accelerated and additionally brings about a markedly reduced yellowing for the same thermal load during curing of the binder system.

The thermodimensional stability of the textile fabric can if necessary be improved by using a crosslinker.

Binder Component D) (Fillers)

The binder system used according to the invention can also contain up to 10% by weight of filler. The fillers being different from the polymers based on polyvinyl alcohol a) above and from the materials contained in the mixture b) above.

Suitable fillers are inorganic fillers of natural and/or synthetic origin.

The inorganic fillers are, for example, mineral fillers, preferably loam, clay, calcined loam, calcined clay, lime, chalk, natural and/or synthetic carbonates, natural and/or synthetic oxides, carbides, natural and/or synthetic hydroxides, sulfates and phosphates, based on natural and/or synthetic silicates, silicas, silicon and/or quartz, fluorite or talc. Optionally, the fillers are silanized or rendered additionally hydrophobic.

Binder Component E) (Additives)

The binder system used according to the invention can also contain up to 10% by weight of additives. These are commercially available additives such as preservatives, stabilizers, anti-oxidants, defoamers, hydrophobing agents, UV stabilizers, plasticizers, adhesion promoters, wetting agents, foaming auxiliaries and/or pigments. These are contained in commercial products to some extent and serve to stabilize storage and transport or can also be added subsequently in order to meet the customers specifications. Most typically, the additives being different from the polymers based on polyvinyl alcohol a) above and from the materials contained in the mixture b) above and from the filler and additives.

The adhesion promoter promotes adhesion of the binder to the surface of the fibers of the textile fabric. Depending on the type of fiber, various adhesion promoters are used. Insofar as the textile fabric has glass fibers, in particular silanes, especially organo-functionalized silanes, are suitable. In these cases the adhesion promoter is preferably silane A187. Such adhesion promoters are marketed, among others, by the company Momentive under the name Silquest A-187.

Textile Fabric

In the context of this description, the term "textile fabric" should be understood in its broadest sense. Thus, this encompasses all structures made from fibers which have been manufactured according to a fabric-forming technique. The fiber-forming materials are natural fibers, mineral fibers, glass fibers, fibers formed from synthetic products and/or fibers formed from synthesized polymers. Woven fabrics, mats, knitted fabrics, crocheted fabrics, non-woven fabrics, particularly preferably non-woven fabrics should be understood to constitute textile fabrics in the context of the present invention.

The textile fabrics based on mineral fibers and/or glass fibers are, in particular, non-woven fabrics based on mineral fibers and/or glass fibers. The aforementioned non-woven fabrics based on mineral fibers and/or glass fibers can also be combined with further textile fabrics, in particular non-woven fabrics.

The glass fiber non-woven fabrics or mineral fiber non-woven fabrics used can be produced by all known methods. In particular, glass fiber non-woven fabrics which are manufactured by means of the wet laying method, the dry laying method or the air laid technique are suitable. In the context of the manufacturing method, in particular in the wet laying method, these non-woven fabrics can also contain small amounts of chemical auxiliaries, e.g., thickeners, defoamers, etc which are dictated by the process. These substances derive from the circulating water during the manufacture of non-woven fabrics.

The mineral fiber non-woven fabrics used according to the invention can be consolidated by the binder system according to the invention and additionally by mechanical measures, e.g., needling or hydrodynamic needling. Particular preference is given to carded non-woven fabrics made of filaments, i.e., continuous fibers or staple fibers. The mean diameter of the mineral fibers is between 8 and 16 μm, preferably between 10 and 12 μm.

Suitable mineral fibers include aluminosilicate, ceramic, dolomite fibers or fibers from vulcanites e.g., basalt, diabase, melaphyre. Diabase and melaphyre. These are collectively referred to as palaeobasalts, wherein diabase is also often referred to as greenstone.

The basis weight of the mineral fiber non-woven fabric used according to the invention is between 20 and 350 g/m$^2$, preferably between 25 and 90 g/m$^2$. The above specifications are also valid for the glass non-woven fabrics described below.

The glass fiber non-woven fabrics used according to the invention can be consolidated by binders or even by mechanical measures, e.g., needling or hydrodynamic needling. The glass fibers may be filaments or continuous or cut glass fibers, wherein in the latter case, the length of the fibers is between 1 and 40 mm, preferably 4 to 20 mm. The mean diameter of the glass fibers is between 6 and 20 μm, preferably between 8 and 15 μm.

Suitable glass fibers include glass types such as E-glass, S-glass, R-glass or C-glass; for economic reasons, E-glass or C-glass is preferred.

Most preferred within the textile fabrics are textile fabrics based on synthetic polymer, in particular synthetic organic polymer. Within the textile fabrics, non-woven fabrics made from fibers formed from synthetic organic polymers, in particular spunbonded fabric, so-called spunbonds, which are produced by a random deposition of freshly melt-spun filaments, are preferred. They consist of continuous synthetic fibers made from melt-spinnable organic polymer materials. Examples of suitable polymer materials are polyamides such as polyhexamethylene diadipamide, polycaprolactam, aromatic or semi-aromatic polyamides ("aramids"), aliphatic polyamides such as nylon, semi-aromatic or fully aromatic polyesters, polyphenylene sulfide (PPS), polymers containing ether and keto groups such as, for example, polyether ketones (PEK) and polyether ether ketone (PEEK), polyolefins such as polyethylene or polypropylene, or polybenzimidazoles.

Preferably, the spun non-woven fabrics are made from melt-spinnable polyesters. Suitable polyester materials are, in principle, all known types suitable for fiber manufacture. Such polyesters consist predominantly of building blocks which are derived from aromatic dicarboxylic acids and aliphatic diols. Common aromatic dicarboxylic acid building blocks are the divalent residues of benzenedicarboxylic acids, in particular terephthalic acid and isophthalic acid; common diols contain 2 to 4 carbon atoms, wherein ethylene glycol is particularly suitable. Particularly advantageous are spun non-woven fabrics which consist of at least 85 mol % of polyethylene terephthalate. The remaining 15 mol % is then built up from dicarboxylic acid units and glycol units, which act as so-called modifiers and which allow the person skilled in the art to specifically modify the physical and chemical properties of the filaments produced. Examples of such dicarboxylic acid units are residues of isophthalic acid or of aliphatic dicarboxylic acid, such as, for example, glutaric acid, adipic acid, sebacic acid; examples of modifying diol residues are those of longer-chain diols, e.g., of propanediol or butanediol, of di- or triethylene glycol or, if present in small amounts, of polyglycol with a molecular weight of about 500 to 2000.

Particular preference is given to polyesters which contain at least 95 mol % of polyethylene terephthalate (PET), in particular those of unmodified PET.

The individual titers of the polyester filaments in the spun non-woven fabric are between 1 and 16 dtex, preferably 2 to 8 dtex.

The basis weight of the fabric used according to the invention made from fibers of synthetic products, in particular of synthetic polymers, is between 20 and 500 g/m$^2$, preferably between 40 and 250 g/m$^2$. The above specifications also apply to spun non-woven fabrics, in particular to spun non-woven fabrics based on melt-spinnable synthetic polymers, wherein polyester is particularly preferred.

In addition to the aforementioned spun non-woven fabrics, so-called staple fiber sheets are also possible based on the synthetic polymer mentioned above. The individual titers of the staple fibers in the staple fiber sheet are usually between 1 and 16 dtex, preferably 2 to 8 dtex. The staple fibers usually have a fiber length of 20-100 mm. The basis weight of the staple fiber sheets is between 20 and 500 g/m$^2$, preferably between 40 and 250 g/m$^2$.

In a further embodiment of the invention, especially when used as reinforcing inserts for roofing sheets, the textile fabrics have at least one reinforcement. This is preferably designed in such a way that the reinforcement absorbs a force so that in the force-expansion diagram (at 20° C.) the reference force of the reinforcing insert with reinforcement compared with the reinforcing insert without reinforcement in the range between 0 and 1% elongation differs by at least 10% at at least one point.

In a further embodiment, the reinforcement can also be installed such that force is absorbed by the reinforcement only at higher extensions.

For economic reasons, preferred reinforcements consist of glass multifilaments in the form of—essentially—parallel yarn sheets or layers. Usually, only one reinforcement is made in the longitudinal direction of the non-woven fabrics by means of—essentially—parallel yarn sheets.

The reinforcing threads can be used as such or in the form of their own textile fabric, for example as a woven fabric, mat, knitted fabric, crocheted fabric or as a non-woven fabric. Preference is given to reinforcements having mutually parallel reinforcing yarns, i.e., warp thread sheets, as well as mats or woven fabrics.

The reinforcement can be effected by incorporating the reinforcements in the textile fabric, on at least one side of the textile fabric, or else at any point of the reinforcing insert, in particular in further textile fabrics which are different from the first textile fabric or as an independent textile fabric.

For use as a reinforcing insert, the consolidated textile fabric according to the invention can have further textile fabrics, in addition to the already described textile fabric according to the invention. These further textile fabrics are preferably different from the first-named textile fabric, i.e., consist of a different material.

Insofar as the textile fabric is constructed from synthetic polymer, it may be necessary to incorporate further textile fabrics into the reinforcing insert according to the invention in order to optimize the application-related properties.

As already described, the textile fabric consolidated by means of the binder system according to the invention has a high proportion of renewable ingredients without adversely affecting the mechanical properties of the consolidated textile fabric. The textile fabrics consolidated by means of the binder system according to the invention have good wet strength and excellent mechanical strength, but are cheaper to produce. The same applies to dimensional stability upon heating, which is also maintained despite the exchange of significant proportions of component a) by components b). Despite the high proportion of component b), the brittleness of textile fabrics consolidated by means of the binder system according to the invention is quite low.

The binder system according to the invention is, furthermore, slightly hygroscopic, so that no restrictions can be envisaged in using the consolidated textile fabrics as reinforcing inserts in the manufacture of PVC flooring, for example by blistering.

The aging behavior of the consolidated textile fabrics, which is almost constant, is also surprising.

In addition, it has been found that the binder system according to the invention allows for very good miscibility. The combination according to the invention polymers based on polyvinyl alcohol and carbohydrate results in binder systems which have a high homogeneity. This high homogeneity results in a good distribution of the binder system and in the textile fabric during the application of the binder system, which in turn leads to very homogeneous properties of the consolidated textile fabric.

Compared with a textile fabric which exclusively has starch as a binder component, the textile fabric consolidated according to the invention is improved or at least equivalent in terms of its hygroscopic behavior, strength, in particular wet and hot strength, brittleness, aging behavior and flexibility.

The textile fabric consolidated according to the invention have a good and/or improved elongation at break, tensile strength, tear strength as well as a good thermal dimension stability (TDS).

Simultaneously, the novel binder systems provides for low moisture take-up during later storage which can cause problems in later handling, e.g. when producing bituminized sheets.

The textile fabric consolidated according to the invention has a moisture take-up of less than 1.5% by weight, preferably less than 1.3% by weight, preferably less than 1.2% by weight, most preferred less than 1.1% by weight. In FIG. 1 the moisture uptake for different binder compositions are displayed. The inventive binder systems shows a greatly improved moisture uptake behavior compared to state of the art starch binder.

The textile fabric consolidated according to the invention has a specific tensile strength of at least 0.3 [(daN/5 cm)/(g/m$^2$)], preferably at least 0.5.

The textile fabric consolidated according to the invention has a tensile strength at break (md/cd) of at least 50/40 [daN/5 cm]; md means machine direction and cd means cross direction.

The textile fabric consolidated according to the invention has a thermal dimension stability (TDS) (md/cd) not more than 1.0/−1.0%.

The textile fabric consolidated according to the invention has a hot tensile strength (md) at 4% elongation of at least 5 daN/5 cm, and a hot tensile strength (md) at 15% elongation of at least 15 daN/5 cm.

Considerable cost savings are made because of the predominant use of carbohydrate. In addition, a completely formaldehyde-free binder system is obtained which, surprisingly, does not cause a deterioration in the product properties, in particular with respect to the mechanical properties of the textile fabric such as, for example, strength.

For the person skilled in the art, it was surprising that the binder system according to the invention can be applied to the textile fabric in a sufficiently high solids concentration.

Accordingly, the binder system according to the invention preferably has a solids concentration of a minimum of 5% by weight, wherein the specifications regarding the proportions by weight are based on the dry mass of the binder system, i.e., without water, and the sum of constituents a) to e) is 100% by weight. The solids concentration of the components a) and b) of the binder system is preferably between 5% by weight and 30% by weight, particularly preferably between 7% by weight and 15% by weight.

The textile fabric consolidated according to the invention can itself be used as a reinforcing insert or in combination with further textile fabrics as a reinforcing insert for coated sarking membrane, roofing and waterproofing sheets, and as a textile backing or textile reinforcement in flooring, in particular fitted carpets and PVC flooring, or in facers, wall coatings for the interior and exterior of buildings, furniture, since these do not suffer from yellowing compared with previous known products, in particular in the case of thermal curing of the binder system, and thus are particularly suitable as a decorative surface. In addition, the textile fabrics consolidated according to the invention can also be used for flooring applications and in the field of filtration.

Coating Materials

Polyethylene or polyvinyl chloride, polyurethanes, EPDM or TPO (polyolefins) are used as coating materials for flooring or carpet backings. In addition, bitumen is used for the coated sarking membranes, roofing and waterproofing sheets.

The bituminized sheets contain at least one carrier membrane—as described above—embedded in a bitumen matrix, wherein the proportion by weight of the bitumen on the basis weight of the bituminized roofing membrane is preferably 60 to 97% by weight and that of the spun non-woven fabric is 3 to 40% by weight.

Manufacture

The textile fabrics used according to the invention are manufactured by means of known methods and procedures. The consolidated textile fabric according to the invention is manufactured using the following steps:

A) forming a textile fabric and, if appropriate, mechanically consolidating the same or supplying a textile fabric, B) applying the inventive binder system comprising:
  a) 0.1 to up to 30% by weight, preferably up to 20% by weight, in particular 1 to 20% by weight of polymers based on polyvinyl alcohol, and
  b) at least 70% by weight, preferably at least 80% by weight, in particular 99 to 80% by weight of a mixture comprising
    (i) at least one carbohydrate; and
    (ii) α-carbon nucleophile crosslinking agent that is an organic compound comprising:
      a first carbon moiety comprising an electron withdrawing group; and
      an α-carbon atom directly bonded to the first carbon moiety, the α-carbon atom has at least one acidic hydrogen atom and the α-carbon atom forms a nucleophile that reacts with a carbonyl carbon on the carbohydrate during polymerization of the binder composition to form the cured binder,
    wherein the mixture has a minimum of 50% by weight of reducing sugars,
  c) 0 to 10% by weight of crosslinker,
  d) 0 to 10% by weight of fillers,
  e) 0 to 10% by weight of additives,
  wherein the specifications of the percentages by weight are based on the dry mass of the binder system, i.e., without water, and the sum of the components a) to e) is 100% by weight, by means of known methods, for example by means of a curtain coater, foam application (e.g., foam padder), or by dipping into a binder bath, optionally removing excess binder, for example by means of suction or mechanically by rolling, C) drying and curing the binder.

The applied quantities and other characteristics of the binder system have already been described in detail in the introduction and are also valid for the method. In particular the low viscosity of the inventive binder system allows an effective application of the binder system onto the textile fabric.

The textile fabric is formed using known means.

The mechanical consolidating which may be carried out is also carried out using known methods.

The reinforcement, if any, is incorporated during or after the formation of the textile fabric or before or during coating with the binder system according to the invention. The supply of the reinforcement and any further optional heat treatment in the manufacturing process is preferably carried out under tension, in particular under longitudinal tension.

Any further textile fabrics to be incorporated are supplied before or during consolidation of the binder system according to the invention.

The application of the binder system in step B) is likewise carried out by means of known methods. The applied binder (after drying) is preferably between 5 and 50% by weight of dry binder, in particular 10 and 40% by weight, particularly preferably 15 and 30% by weight of dry binder, based on the total weight of the raw textile fabric.

Because of the nature of the binder according to the invention, it is possible for the required amount of binder to be applied in one application step.

Drying or consolidating and curing of the binder is likewise accomplished by means of methods known to the person skilled in the art, wherein temperatures of at least 180° C. to 250° C. have been shown to be advantageous.

The individual method steps are known per se, but they are patentable in the combination or sequence of the invention and the use of the binder system according to the invention.

Measurement Methods:

Basis weight: The basis weight is determined according to DIN EN ISO 29073-1 (1992-08).

Fiber diameter measurement: The fiber diameter is determined according to DIN EN ISO 1973 (1995-12).

Reference force measurement (tensile at x % elongation): The reference force is measured according to DIN EN 29073, part 3 (1992-08), on 5 cm wide specimens with a clamping length of 200 mm. The numerical value of the preload force, expressed in centinewton, corresponds to the numerical value of the basis weight of the sample, expressed in grams per square meter.

Hot tensile at x % elongation: reference force at 200° C.

Viscosity: Viscosity is determined according to DIN EN ISO 2555 (2000-01) and at 23° C.

Solids content: The solids content in an aqueous polymer dispersion or polymer solution is determined according to DIN EN ISO 3251 (2008-06).

Determination of pH values: The pH value is determined according to DIN ISO 976 (1998-05).

Moisture takeup: The moisture takeup is measured via graphimetric means. The specimen is dried at 110° C. under humidity-free atmosphere for at least 120 min. After cooling to room temperature the weight of the sample is continuously measured for at least 20 min while being exposed to a controlled atmosphere with 55% RH and 23° C.

Tensile strength: The tensile strength is measured according to DIN EN 29 073, part 3 (1992-08).

Specific tensile strength: The tensile strength is measured according to DIN EN 29 073, part 3 (1992-08). The specific tensile strength is calculated via the formula: (tensile strength in md+tensile strength in cd)/area weight [daN 5 cm)/(g/m$^2$)].

Hot tensile strength: The hot tensile strength is determined according to DIN EN 29 073, part 3 (1992-08) at 200° C.

Thermal dimensional stability (TDS): The thermal dimensional stability (TDS) is determined according to DIN 18192: 1985-08 using a force of 4000 g at 200° C.

EXAMPLES

Samples have been prepared using well-known standard spunbond manufacturing machinery and methods. The polymer material was 100% polyethylene terephthalate (PET), the filament titer was 4 dtex. The spunbonded nonwoven materials were consolidated by mechanical needling using a needling density of 40 stiches per cm$^2$. After needling the spunbond material was immersed into a binder bath. Excess binder was removed by squeezing roles. The fabric was then forwarded to an oven for drying and consolidation. The oven temperature was ca. 220° C. Area weight of the spunbond material and the binder content of the examples can be taken from Table 1.

The table below (Table 1) exhibits the results of various parameter measured on samples comprising 100% Alpha-binder, and samples comprising the inventive binder with two different compositions.

TABLE 1

| | | Trial-No. OP 1005 | | |
|---|---|---|---|---|
| | | 1 | 3 | 4 |
| | | Alpha-Binder | | |
| | | 100 | 90 | 80 |
| | | PVOH | | |
| | | | 10 | 20 |
| | | Numbers in percent by weight dry | | |
| binder add on | [%] | 20.3 | 19.8 | 19.5 |
| unit area weight | [gsm] | 182 | 189 | 187 |
| spec. tensile strength | [(daN/5 cm)/(g/m$^2$)] | 0.47 | 0.53 | 0.58 |
| tensile strength md | [daN/5 cm] | 47.7 | 58.6 | 63.3 |
| tensile strength cd | [daN/5 cm] | 37.0 | 41.4 | 44.3 |
| elongation md | [%] | 30.8 | 34.8 | 34.1 |
| elongation cd | [%] | 43.1 | 44.4 | 43.0 |
| tensile at 4% elongation md | [daN/5 cm] | 24.5 | 36.4 | 40.5 |
| tensile at 15% elongation md | [daN/5 cm] | 34.5 | 41.8 | 48.5 |
| tensile at 4% elongation cd | [daN/5 cm] | 13.4 | 21.1 | 25.5 |
| tensile at 15% elongation cd | [daN/5 cm] | 20.5 | 24.9 | 29.0 |
| tear strenght md | [daN] | 27.4 | 28.1 | 27.1 |
| tear strenght cd | [daN] | 31.8 | 39.6 | 35.4 |
| TDS md | [%] | 0.8 | 0.8 | 0.7 |
| TDS cd | [%] | −1.3 | −0.8 | −0.7 |
| hot tensile at 1% elongation md | [daN/5 cm] | 1.5 | 1.50 | 1.80 |
| hot tensile at 4% elongation md | [daN/5 cm] | 5.7 | 7 | 7 |
| hot tensile at 15% elongation md | [daN/5 cm] | 13.9 | 18 | 17 |

The invention claimed is:

1. A textile fabric consolidated with a binder system comprising:

a) 0.1 to up to 30% by weight of polymers based on polyvinyl alcohol, wherein the polyvinyl alcohol has a degree of saponification of at least 80%, and b) at least 70% by weight of a mixture comprising:

(i) at least one carbohydrate; and (ii) an α-carbon nucleophile crosslinking agent that is an organic compound comprising:

a first carbon moiety comprising an electron withdrawing group; and an α-carbon atom directly bonded to the first carbon moiety, the α-carbon atom has at least one acidic hydrogen atom and the α-carbon atom forms a nucleophile that reacts with a carbonyl carbon on the carbohydrate during polymerization of the binder system to form a cured binder, wherein the mixture has a minimum of 50% by weight of reducing sugars, c) a crosslinker, wherein the crosslinker is present in an amount from 0.1 wt. % to 10% by weight, said crosslinker being different from the crosslinking agent (ii) above and comprising a synthetic resin based on one or both of urea-formaldehyde and melamine-formaldehyde, d) 0 to 10% by weight of fillers, said fillers being different from the polymers based on polyvinyl alcohol a) above and from the mixture b) above, e) 0 to 10% by weight of additives, wherein:

proportions by weight are based on a dry mass of the binder system, i.e., without water, and a sum of a) to e) is 100% by weight.

2. The textile fabric according to claim 1, wherein a) the polymers based on polyvinyl alcohol are present in an amount up to 25% by weight.

3. The textile fabric according to claim 1, wherein b) the mixture is present in an amount of at least 80% by weight.

4. The textile fabric as claimed in claim 1, wherein a sum of a) and b) is at least 80% by weight.

5. The textile fabric according to claim 1, wherein a quantity of the binder system applied to the textile fabric, determined after drying, is between 5 and 50% by weight of dry binder.

6. The textile fabric according to claim 1, wherein the carbohydrate exclusively comprises reducing sugars.

7. The textile fabric according to claim 1, wherein the textile fabric comprises natural fibers, mineral fibers, glass fibers, fibers formed from synthetic products and/or fibers formed from synthesized polymers.

8. The textile fabric according to claim 1, wherein the textile fabric is a woven fabric, a mat, a knitted fabric, or a non-woven fabric.

9. The textile fabric according to claim 1, wherein the textile fabric is a mineral fiber non-woven fabric or a glass fiber non-woven fabric with a basis weight between 20 and 350 $g/m^2$.

10. The textile fabric according to claim 1, wherein the textile fabric is a non-woven fabric formed from synthetic polymers with a basis weight between 20 and 500 $g/m^2$.

11. The textile fabric according to claim 1, wherein the textile fabric has a moisture take-up of less than 1.5% by weight.

12. The textile fabric according to claim 1, wherein the textile fabric has a specific strength of at least 0.3 [daN $m^2$/5 cm g].

13. The textile fabric according to claim 1, wherein the textile fabric has a tensile strength at break (md/cd) of at least 50/40 [daN/5 cm].

14. The textile fabric according to claim 1, wherein the textile fabric has a thermal dimension stability (TDS) (md/cd) not more than 1.0/−1.0%.

15. The textile fabric according to claim 1, wherein the textile fabric has a hot tensile strength (md) at 4% elongation of at least 5 daN/5 cm, and a hot tensile strength (md) at 15% elongation of at least 15% daN/5 cm.

16. The textile fabric according to claim 1, wherein the textile fabric comprises a reinforcement insert.

17. A method for manufacture of a textile fabric which is consolidated with a binder, comprising the steps of:

A) forming a textile fabric;

B) applying a binder system comprising:

a) 0.1 to up to 30% by weight of polymers based on polyvinyl alcohol, wherein the polyvinyl alcohol has a degree of saponification of at least 80%, and b) at least 70% by weight of a mixture comprising:

(i) at least one carbohydrate; and (ii) an α-carbon nucleophile crosslinking agent that is an organic compound comprising:

a first carbon moiety comprising an electron withdrawing group; and an α-carbon atom directly bonded to the first carbon moiety, the α-carbon atom has at least one acidic hydrogen atom and the α-carbon atom forms a nucleophile that reacts with a carbonyl carbon on the carbohydrate during polymerization of the binder system to form a cured binder, wherein the mixture has a minimum of 50% by weight of reducing sugars, c) a crosslinker, wherein the crosslinker is present in an amount from 0.1 wt. % to 10% by weight, said crosslinker being different from the crosslinking agent (ii) above and comprising a synthetic resin based on one or both of urea-formaldehyde and melamine-formaldehyde, d) 0 to 10% by weight of fillers, said fillers being different from the polymers based on polyvinyl alcohol a) above and from the mixture b) above, e) 0 to 10% by weight of additives, wherein proportions by weight are based on a dry mass of the binder system, i.e., without water, and a sum of a) to e) is 100% by weight, by means of known methods, C) drying and curing the binder.

18. The method according to claim 17, wherein a proportion of a) (polymers based on polyvinyl alcohol) is between about 1 to 20% by weight.

19. The method according to claim 17, wherein the textile fabric comprises one or more of natural fibers, mineral fibers, glass fibers, fibers formed from synthetic products and fibers formed from synthesized polymers.

20. The method according to claim 17, wherein the binder system is applied in one application step.

* * * * *